United States Patent [19]

Moylan

[11] 4,437,666

[45] Mar. 20, 1984

[54] MECHANICALLY PROGRAMMABLE CHESS PLAY INDICATOR

[76] Inventor: John J. Moylan, 658 Aipuni St., Honolulu, Hi. 96821

[21] Appl. No.: 295,380

[22] Filed: Aug. 24, 1981

[51] Int. Cl.[3] ..... A63F 3/02

[52] U.S. Cl. ..... 273/141 R; 273/260

[58] Field of Search ..... 273/141 R, 141 A, 260, 273/261, 236, 242, 255; D21/21, 22, 24, 39

[56] References Cited

U.S. PATENT DOCUMENTS

| | | | |
|---|---|---|---|
| 1,265,497 | 5/1918 | Parker | 273/282 X |
| 1,525,417 | 2/1925 | Steinberg | 273/260 X |
| 3,794,326 | 2/1974 | Bialek | 273/260 |

FOREIGN PATENT DOCUMENTS

| | | | |
|---|---|---|---|
| 2239081 | 2/1975 | France | 273/255 |
| 5877 | of 1909 | United Kingdom | 273/141 R |
| 223050 | 10/1924 | United Kingdom | 273/141 R |
| 430249 | 6/1935 | United Kingdom | 273/255 |
| 1187095 | 4/1970 | United Kingdom | 273/243 |

*Primary Examiner*—Paul E. Shapiro

[57] ABSTRACT

A mechanically programmable chess play indicator having a flattened body upon which is mounted a spinner, two rings of pegs concentrically surrounding the pivot of the spinner for indicating a particular chess piece to be moved, a nine square checkerboard centered on the pivot of the spinner for indicating the direction the chess piece is to be moved, and rings of indicia concentrically arranged with respect to the pivot of the spinner for indicating the nature and extent of the move to be made. A ring of white pegs indicates the white pieces of a chess set and a ring of black pegs indicates the black pieces of a chess set, there being more pegs in each ring than there are corresponding black or white pieces, and an end of each peg bearing an indicium identifying a particular chess piece. The game is played by spinning the spinner first to select the piece to be played, then spinning to determine the direction of movement, then spinning to determine the extent of movement, moves and captures being made in accordance with conventional rules of chess. Where an illegal move is indicated, the spinner is indexed (advanced) to the next indicium. Mechanical programming is accomplished by adjusting circumferential spacing of the indicia exhibiting pegs.

3 Claims, 4 Drawing Figures

MECHANICALLY PROGRAMMABLE CHESS PLAY INDICATOR

BACKGROUND OF THE INVENTION

1. Field of the Invention

The present invention relates to chess games, and more particularly to devices for indicating moves to be made by the player.

2. Description of the Pior Art

It has previously been known to incorporate the element of chance into an otherwise conventionally played chess game. For example, U.S. Pat. No. 3,794,326 issued Feb. 26, 1974 to Bialek utilizes a special form of dice for such purpose. The element of chance in not pre-programmable by the operator.

Various chess games have been proposed in which variations on conventional chess may be played, see for example U.S. Pat. No. 3,881,731 issued May 6, 1975 to Droney. This type of chess game also does not provide for pre-programming an element of chance into the selection of plays to be made.

Applicant has not found any chess game which is pre-programmable to control play. The nearest approach to the concept of pre-programming to control play is found in U.S. Pat. No. 3,709,498 issued Jan. 9, 1953 to Liston. In this device, which relates to a game other than chess, the programming is preselected by the player and does not include the element of chance.

U.S. Pat. No. 3,248,116 issued Apr. 26, 1966 to Pawelka et al. shows a wheel of fortune which can be programmed to stop more often at certain positions by extending or retracting peripheral pins. This wheel of fortune has nothing to do with chess and is not capable of indicating which men are to be moved and in what direction on the conventional chessboard.

SUMMARY OF THE INVENTION

The novel mechanically programmable chess play indicator of the present invention is a simple mechanical device designed to play out complete games of chess with any conventional chess set. It allows any strength player to be highly competitive without excluding the use of the player's chess ability, which is challanged in a new dimension.

The present invention permits competitive chess games to be played by one person, thus eliminating the old disappointment of not finding a chess partner. A single person can play the game alone for hours with great enjoyment, finding no two games alike and many interesting sacrifices and suprise endings. A freely rotatable spinner on a suitable base during each play indicates the next chessman to be moved, the direction it is to be moved, and the extent of the move. The moves are made in accordance with the rules of conventional chess, with only minor modifications to adapt to indication by the spinner.

It is therefore a principal object of the present invention to provide a chess play indicator capable of selecting both the chessman to be moved and the nature and extent of the move.

Another object of the present invention is to provide a chess play indicator of the character described which may be mechanically programmed to vary the relative probability of designated chess pieces being selected by the "selection" spin of the rotatable pointer, thus combining programmability with chance selection.

A further object of the present invention is to provide a programmable chess play indicator of the character set forth in which the program is accomplished mechanically by simply inverting and/or arranging chess piece indicating elements of the device.

A still further object of the present invention is to provide a mechanically programmable chess play indicator of the character described which is simple and sturdy in construction, attractive in appearance, and easy to operate.

Another object of the present invention is to provide a method of playing chess which utilizes mechanical programming steps to vary the relative probability of specified chess pieces being selected.

For a fuller understanding of the nature and further objects and features of advantage of the present invention, reference should be had to the following detailed description, taken in connection with the accompanying drawings and the appended claims.

While only the preferred embodiment of the invention has been illustrated with drawings, it will be apparent as the specification progresses that modifications could be made to the illustrated structure within the ambit of the claims.

DESCRIPTION OF THE PREFERRED EMBODIMENTS

Figure 1:
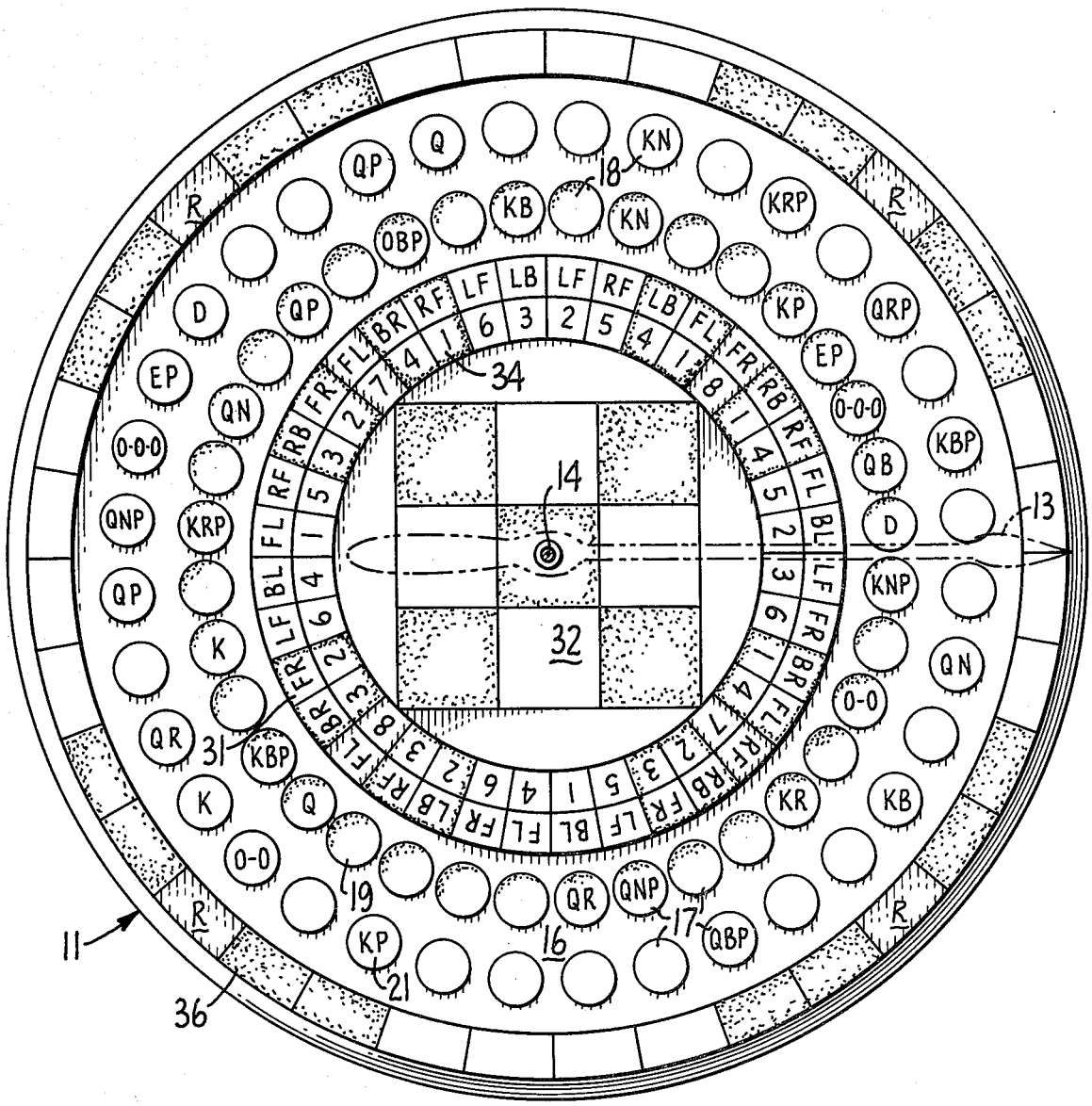
FIG. 1 is a plan view of a mechanically programmable chess play indicator constructed in accordance with the present invention.
Figure 2:
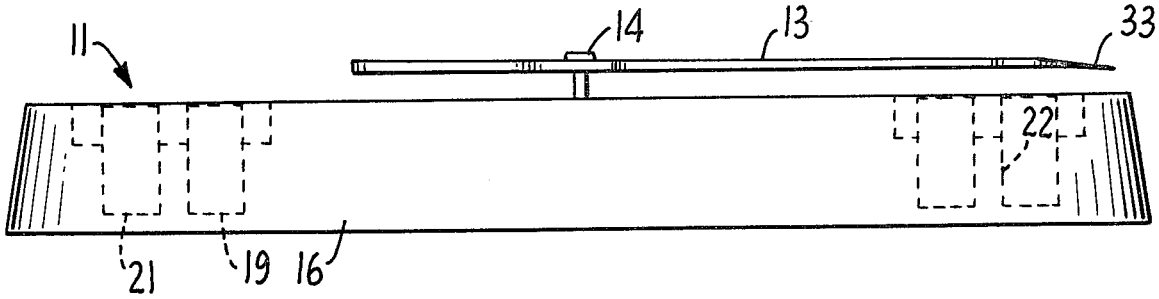
FIG. 2 is a side elevational view of the mechanically programmable chess play indicator of FIG. 1.
Figure 3:
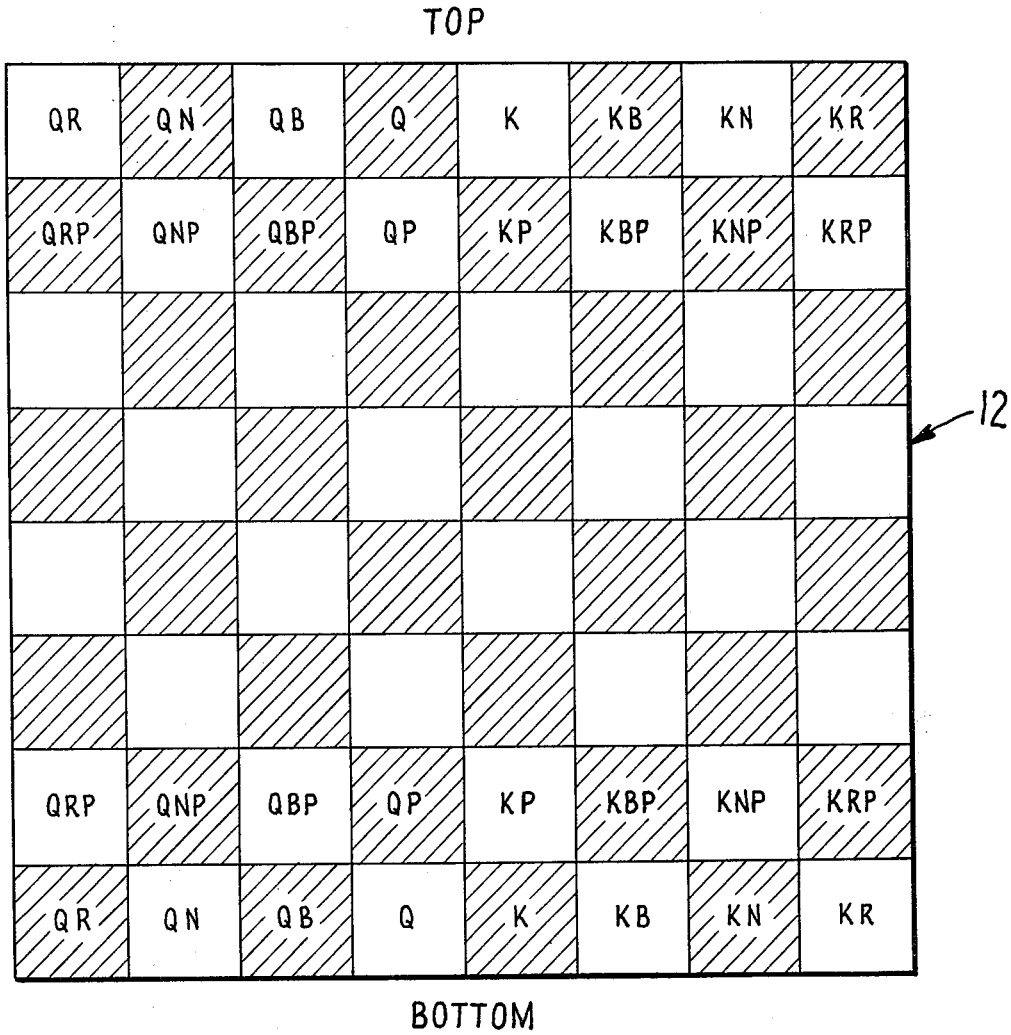
FIG. 3 is a plan view of a chessboard illustrating the mode of play as controlled by the device of FIGS. 1 and 2.
Figure 4:
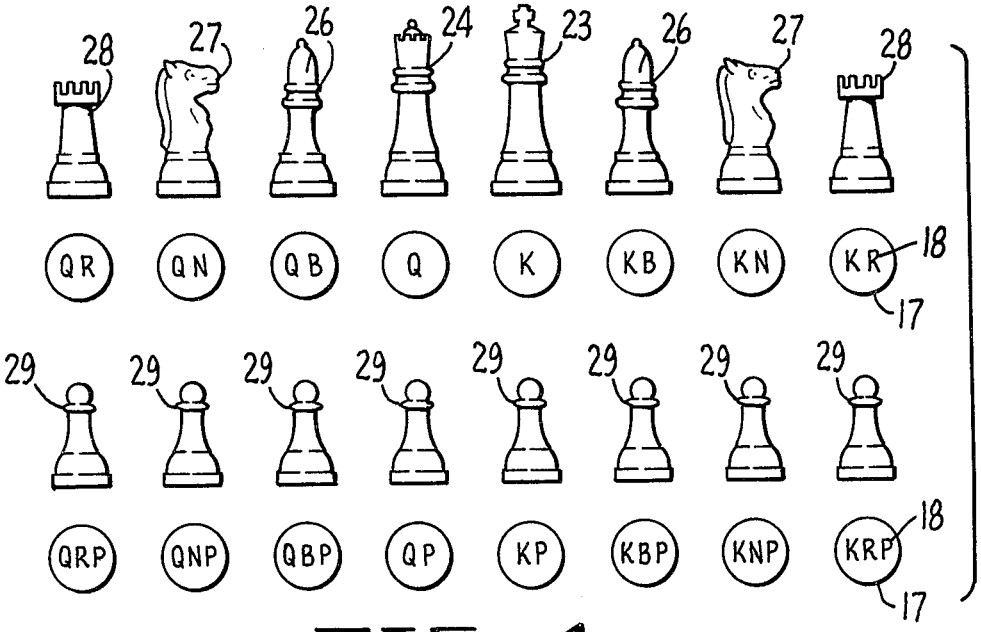
FIG. 4 is a side elevational view of conventional chessmen, each of which is shown in proximity to a corresponding indicating peg forming part of the apparatus of FIGS. 1 and 2.

Referring now to the drawings in detail, it will be seen that the mechanically programmable chess play indicator of the present invention is adapted for use with a conventional chess set, of the character illustrated in FIGS. 3 and 4 of the drawings, for indicating the next chess piece to be moved and the nature of the move to be made. As shown in FIGS. 1 and 2 of the drawings, the apparatus 11 indicates the next play to be made on the chessboard 12 by the operation of an elongated, narrow spinner or pointer 13 pivotally mounted at 14 for free spinning rotation on a supporting body 16, a plurality of objects 17 being removably mounted on the body 16 in a plurality of positions individually alignable with the spinner 13, with at least a portion of the objects 17 having individual indicia 18 corresponding with the conventional chessmen whereby the coming to rest of pointer 13 after being spun indicates the next chess piece to be played.

As here shown, the objects 17 are provided in the form of pegs arrayed in a circle surrounding the pivotal mounting 14 of the pointed 13 in equally, circumferentially spaced relation. Separate rows 19 and 21 of the pegs 17 are concentrically positioned around pivot 14, with one row, say row 19, indicating the black chess pieces and the other row, say row 21, indicating the white chess pieces. For convenience in identification, the pegs in row 21 are preferably colored white and the pegs in row 19 are preferably colored black.

White and black take turns moving as in conventional chess and reference is therefore had alternatively to the outer ring 21 (white) and the inner ring 19 (black) of the pegs 17. During each play, the pointer 13 is spun first to determine which of the chess pieces shall be moved.

As a feature of the invention, in the event the particular chess piece indicated is blocked and cannot move, or a blank peg is indicated, the pointer is "indexed" in a desired direction, usually clockwise, until it arrives at a piece which can be moved. This "indexing" feature greatly facilitates play by eliminating repeated spinning of the pointer and makes possible the mechanically programmable aspect of the apparatus.

Mechanical programmability is provided by utilizing more of the pegs 17 and their corresponding receiving sockets 22 in each row than there are conventional chess pieces to be indicated. In conventional chess there are 16 white pieces and 16 black pieces. A set of chess pieces is illustrated in FIG. 4 of the drawings, with each such piece being positioned directly above the corresponding peg 17 bearing indicium 18 identifying the particular chess piece.

As shown in FIG. 4, the chess pieces (sometimes called "chessmen") of each color include a king 23, a queen 24, two bishops 26, two knights 27, and two rooks 28. These pieces are arrayed in order shown on the top and bottom rows of the chessboard 12 with the white pieces occupying one of these rows and the black pieces occupying the other. On the next inwardly row of chessboard squares, eight pawns are arrayed, with one pawn in front of each of the previously named pieces.

The indicia 18 on the pieces identifying pegs 17 may be in any suitable form capable of identifying the particular piece corresponding to the peg on which the indicium is carried. A conventional notation to identify chess pieces is shown in FIG. 4, in which the king is labeld "K", the queen is labeled "Q", the bishop on the king's side is labeld "KB" (signifying king's bishop) the knight on the king's side is labeled "KN" (signifying king's knight), and the rook on the king's side is labeled "KR" (signifying king's rook). The bishop, knight and rock on the queen's side are similarly labeled, substituting "Q" for "K".

The pawns 29 immediately ahead of the back row pieces are identified by that relationship. Thus, the king's pawn is labeled "KP", the queen's pawn in labeled "QP", the king's bishop's pawn is labeled "KBP", etc.

The method of play is based on official chess rules, which are followed except for the following changes:

(1) Castling may be accomplished only once for each side, when the pointer calls for it (when the pointer indicates the peg labeled 0-0, for castling on the king's side, or 0-0-0, for castling on the queen's side) and the proper, legal position exists, whether or not the king or castling rook has previously been moved.

(2) There is no optional en passant capture. The mover will capture en passant when the spinner 13 calls for it and the proper legal position exits. Use file locating, infra, for all en passant dilemnas as to which pawn will capture. Use directional spin, infra, for dilemnas as to which pawn will be captured.

(3) When playing the regular version of the present game, checkmate is accomplished by odds based on the defense's strength and will seldom shown a true checkmate position on the chessboard.

Once the first spin of pointer 13 has selected the chess piece to be moved, the pointer is spun again to determine the direction of the move. The direction of knight moves is provided by a concentric ring 31 of indicia underlying the pointer 13. Ring 31 is divided into a plurality of consecutive sections, each of which bears two letters. The first of these letters indicates the direction in which the knight moves one consecutive squares and the second of these letters indicates the direction in which the knight moves two squares. The letters used are "F" for forward, "B" for backward, "L" for left, and "R" for right. Thus, if the pointer indicates, for example, the letters "LF", the knight is moved one square to the left and two squares forward. If the designated landing square for the knight is blocked by a piece of the same color as the knight, the pointer 13 is indexed clockwise to the next legal move which can be made.

In order to designate the direction in which the indicated piece is to move (apart from knights) a nine square checkerboard 32 is centered under the spinner 13. On the second spin, after the piece to be moved has been selected by the first spin, pointer 13 is spun again to indicate the direction in which such piece should move. Since bishops can only move diagonally, and rooks can only move along vertical files or horizontal courses, should the pointer 13 indicate the wrong direction of movement, it is indexed in a clockwise direction until it reaches a correct direction of movement for the particular piece. Spinner 13 has a pointed end 33, which indicates the direction of movement to be made.

The distance the piece selected by the first spin is to move, in the direction selected by the second spin, is controlled by numbers located in consecutive sections of a ring 34 concentric to the pivotal mounting 14 of the spinner 13. The third spin of pointer 13 will land upon one of the numbers (which run from 1 through 8) to indicate how many squares the piece should be moved. If the final square is empty, and noe of the intervening squares are occupied, the piece is moved a designated number of squares. If the final square is occupied by a piece of different color, and none of the intervening squares are occupied, the piece moves to the designated final square and captures the piece thereon. If the final square is occupied by a piece of the same color as the moving piece, or any of the intervening squares are occupied, the pointer 13 is not indexed, but the piece moves its legal amount of squares up to the number selected. This saves extra spins.

It should be noted that, in each instance, when the pointer 13 does not indicate a legal move, it is indexed until it does so. This greatly speeds up the game, as otherwise repeated spins would have to be made until the spinner indicated a legal move.

Conveniently, and to facilitate reading the device, the sockets 22 and their pegs 17, the sections in ring 31 and the sections in ring 34 are each arranged on a radius positioned 10 degrees from the adjacent radii, so that 36 radial positions are provided. An outer ring 36 is also divided into 36 segments of equal size, each centered on one of the described radii. The spinner point 33 is adjacent to ring 36 so it can readily be ascertained which of the pegs in rows 19 and 21, or the sections in rings 31 and 34 are being indicated. Preferably, the segments of ring 36 are colored black or white to provide black or white sections indicating whether pointer 13 is pointing to one of the black corner squares of the indicating checkerboard 32, or one of the white squares.

Mode of Play

The apparatus of FIGS. 1 and 2 is placed next to the chessboard 12 within easy reach of the player, and with the squares of the indicating checkerboard 32 aligned parallel to the chessboard squares. The apparatus is then left in this position during the entire game.

After deciding colors, the white pegs 17 are inserted into their sockets with either the indicium and/or the blank end showing and in accordance with the strategic programming desired by the player. The black pegs are then set for a defense in a similar manner, and both sets of pegs are left in such positions the entire game.

Each move of the game consists of three steps, any of which may be eliminated when the result would be obvious. For example, if only one piece, the king, is left on the board, it is obvious that the king would have to be moved. Likewise, if a particular piece, such as a bishop, is indicated and there is only one legal square to which that piece could move, that move would be obvious.

Step 1. The spinner is spun for the pegs 17 only. The first legal chessman or play selection found by the spinner must be the one used on the chessboard (indexing and locating if necessary).

Draw Rule: If the spinner 13 is spun (not indexed) directly to a peg having the indicia "D", signifying draw, or any blank peg preceding peg D, it is spun once more from that position. If, on this second spin, the spinner stops again directly on peg D or one of its spacers (if any), the game is a draw. If a draw is not indicated on such second spin, the game is continued with Step 1 where the spinner does stop, (indexing if necessary). Indexing (not spinning) to peg D or its spacers (if any) at any time is considered no move and must be indexed onward. Spacing peg D is considered illegal unless agreed upon by all players concerned.

Step 2. The pointer 13 is spun (and indexed if necessary) to the first square on checkerboard 32 which would indicate a legal direction to move on the chessboard. The chessman will then move in the direction indicated due to the fact that the squares of the checkerboard 32 are parallel to the squares of the chessboard. If the piece selected to be moved is a knight, reference is had to ring 31 rather than checkerboard 32. During directional selections only, if pointer 13 is spun (not indexed) to red on ring 36 (the sections marked with the letter "R"), it must be spun again. This keeps the directional selection more balanced.

Step 3. The spinner is spun for the number of squares indication in ring 34. The number the spinner stops on will indicate the number of squares available for the chessman to move in the direction selected in Step 2. The chessman is then moved as many squares as legally possible up to this number, including capturing when in position to do so. When pawns, selected to move straight ahead on their first move, have two squares directly in front of them vacant, use numbers one and two only in the third spin, plus indexing if necessary. The first one of these two numbers found by the spinner will indicate what rank (3 or 4) to which the pawn will move.

Removing the king from check. This procedure consists of three steps, any of which may be eliminated when the result would be obvious.

Observing Step: Every chessman including the king that could legally remove the king from check must be observed and counted. If the king cannot be removed from check the game is over, otherwise continue with the "Selecting" Step, which must be repeated (if necessary) as many times as the full count taken of chessmen in the "Observing" Step.

Selecting Step: This involves one direct spin for the pegs 17 only (no indexing). If the spinner stops on a peg 17 (or one of the spacer pegs, if any) with the last letter of its indicium representing any one or more of the chessmen observed in the "Observing" Step, remove the king from check with this selection, locating if necessary when there is more than one chessman observed in the "Observing" Step, represented by the same last letter. In the "Selecting" Step, the four play pegs ("EP" for en passant, "D" for draw, and "O-O" and "O-O-O") represent and function as spacers only.

For any chessman but the knight, the spinner is spun (and indexed if necessary) to the first legal direction that could remove the king from check and the selected piece is moved the legal number of squares necessary to remove check. For the knights, the spinner is spun (and indexed if necessary) to the first legal position indicated by ring 31 and the selected knight is moved to this position to remove check.

King Move Step: If the "selecting" Step fails, and if the king was counted in the "Observing" Step, one direct spin (no indexing) is made. If the spinner indicates a legal direction on checkerboard 37 that will remove the king from check, the king is moved one square in such direction to remove check.

Further special rules for special situations may be made by agreement between the players, such as limiting the number of spins which can be utilized to remove the king from check, etc. In any such case, the basic rules of chess governing movement of pieces are still used. It is also advisable to mark the king's rooks and the king's knights in some manner so they can always be located as they are moved about the board.

From the foregoing, it will be apparent that the mechanically programmable chess indicator of the present invention provides a novel and highly entertaining method and apparatus for playing a game based on the rules and apparatus used in conventional two opponent chess.

What is claimed is:

1. A mechanically programmable chess play indicator, comprising a flattened supporting body, an elongated pointer pivotally mounted on said supporting body for free spinning rotation sweeping a circular area thereof, a plurality of objects colored to correspond to the white and black chessmen and arrayed in concentric circles surrounding the pivotal mounting of said pointer and in equally circumferentially spaced relation to each other, with the objects corresponding to the white chessmen being interchangeable with each other in one circle and the objects correspondingto the black chessmen being interchangeable with each other in the other circle, the positions for said objects in said circles exceeding the total number of chessmen represented by said objects in said circles whereby desired ones of said positions are unsupplied with said indicia corresponding with the conventional chessmen so that, when said pointer comes to rest not aligned with one of said objects having such indicia, said pointer may be indexed in the chosen direction of rotation until it reaches alignment with one of said objects, the number of positions unsupplied with indicia before a particular indicium is reached determining the relative probability of that indicium becoming aligned with said pointer on each play, a plurality of knight positions also being provided on said body at positions individually alignable with said pointer, each of such knight positions being occupied by an indicium indicating a possible knight move whereby, when the first spin of said pointer indicates a knight is to be moved, a second spin causes the pointer to become aligned with one of said knight positions and thus indicate the move to be made by such knight.

and wherein a plurality of move extent positions are also provided on said body at positions individually alignable with said pointer, each of which is occupied by a number indicating the number of consecutive squares on the chessboard which chosen queen and bishops and rooks are to move whereby, when the first spin of said pointer indicates a queen or bishop or rook or pawn is to be moved, another spin causes the pointer to become aligned with one of said move extent positions and thus indicate the number of squares the indicated piece is to move, and wherein a checkerboard having nine alternating light and dark squares is provided on said body centered on the pivotal mounting of said pointer whereby, when the first spin of said pointer indicates a king or queen or bishop or rook or pawn is to be moved, another spin causes said pointer to indicate the direction the indicated piece is to move.

2. Apparatus as described in claim 1, and wherein said objects are cylindrical pegs mountable in sockets formed in said supporting body with each peg having one end bearing and indicium corresponding to a conventional chess piece and an opposite blank end, and wherein said pegs are reversible in their sockets.

3. A mechanically programmable chess play indicator, comprising a supporting body, an elongated pointer pivotally mounted on said supporting body for free spinning rotation, a plurality of objects removably and interchangeably mounted on said body in a plurality of positions individually alignable with said spinner, at least a portion of said objects having individual indicia corresponding with each of the pieces of a conventional chess set whereby the coming to rest of said pointer after being spun indicates the next chess piece to play, a checkerboard having nine alternating light and dark squares provided on said body and centered on the pivotal mounting of said pointer whereby, when the first spin of said pointer indicates a king or queen or bishop or rook or pawn is to be moved, another spin causes this pointer to indicate the direction the indicated piece is to move.

* * * * *